US008971545B2

(12) United States Patent
Epping

(10) Patent No.: US 8,971,545 B2
(45) Date of Patent: Mar. 3, 2015

(54) EARPIECE

(75) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 552 days.

(21) Appl. No.: 13/148,770

(22) PCT Filed: Feb. 11, 2010

(86) PCT No.: PCT/EP2010/051726

§ 371 (c)(1),
(2), (4) Date: Aug. 18, 2011

(87) PCT Pub. No.: WO2010/092118

PCT Pub. Date: Aug. 19, 2010

(65) Prior Publication Data

US 2011/0311070 A1 Dec. 22, 2011

(30) Foreign Application Priority Data

Feb. 11, 2009 (DE) ..... 10 2009 008 376

(51) Int. Cl.
*H04R 1/10* (2006.01)

(52) U.S. Cl.
CPC ..... *H04R 1/1016* (2013.01); *H04R 2225/025* (2013.01)
USPC ..... 381/74; 381/312; 381/322; 381/328; 381/380

(58) Field of Classification Search
CPC ..... H04R 1/1016; H04R 2225/025
USPC ..... 381/74, 309, 312, 322, 328, 379, 380
See application file for complete search history.

(56) References Cited

U.S. PATENT DOCUMENTS

| | | | | |
|---|---|---|---|---|
| 4,298,087 | A | 11/1981 | Launay | |
| 4,375,016 | A * | 2/1983 | Harada | 181/135 |
| 2001/0050997 | A1 | 12/2001 | Cho | |
| 2007/0036385 | A1 * | 2/2007 | Harvey et al. | 381/388 |
| 2007/0201717 | A1 * | 8/2007 | Dyer et al. | 381/380 |

(Continued)

FOREIGN PATENT DOCUMENTS

| | | |
|---|---|---|
| CN | 101106833 | 1/2008 |
| CN | 201114712 | 9/2008 |
| DE | 35 40 579 | 5/1987 |

(Continued)

OTHER PUBLICATIONS

Chinese Notification of first Office Action dated Sep. 26, 2013.

(Continued)

*Primary Examiner* — Paul S Kim
(74) *Attorney, Agent, or Firm* — Frommer Lawrence & Haug LLP

(57) ABSTRACT

There is provided an earpiece having a first side towards the ear, an acoustic transducer for outputting a sound signal and a sound guide element having a first end and a second end. In that case the first end faces the acoustic transducer and the second end faces the first end of the (ear canal) earpiece. The sound guide element serves for guiding the sound signal to an ear canal of a user. The sound guide element has a first opening at its second end. The (ear canal) earpiece also has at least one volume element which delimits a volume and which has at least one second opening for connecting the volume to the first end of the ear canal earpiece.

15 Claims, 11 Drawing Sheets

(56) References Cited

U.S. PATENT DOCUMENTS

| | | | | |
|---|---|---|---|---|
| 2008/0013772 | A1* | 1/2008 | Yang | 381/379 |
| 2008/0095393 | A1 | 4/2008 | Klein et al. | |

FOREIGN PATENT DOCUMENTS

| | | |
|---|---|---|
| DE | 37 06 481 | 9/1987 |
| DE | 10 2005 012 711 | 10/2005 |
| DE | 10 2006 042 209 | 11/2007 |
| EP | 0 040 259 | 11/1981 |
| JP | 8 37697 | 2/1996 |
| JP | 2006 237690 | 9/2006 |
| JP | 2006 287674 | 10/2006 |

OTHER PUBLICATIONS

Chinese Search Report dated Sep. 10, 2013.

* cited by examiner

EARPIECE

The present application claims priority from PCT Patent Application No. PCT/EP2010/051726 filed on Feb. 11, 2010, which claims priority from German Patent Application Nos. DE 10 2009 008 376.6 filed on Feb. 11, 2009, the disclosures of which are incorporated herein by reference in their entirety.

BACKGROUND OF THE INVENTION

1. Field of the Invention

The invention concerns an earpiece and an ear pad for an ear canal earpiece.

2. Description of Related Art

Ear canal earpieces are also known as in-ear earpieces. Such earpieces generally have an acoustic sound transducer which is fitted into a housing which is inserted intra-aurally, that is to say into the ear canal. Frequently an ear pad is arranged around the housing so that wearing the ear canal earpiece in the ear is more pleasant for the user. Disposed on the housing is an electrical connection for a cable which carries an electrical signal to the sound transducer.

When such an ear canal earpiece is inserted into the ear canal of a user then the ear canal earpiece substantially air-tightly closes the ear canal. The sound emitted by the transducer thus passes from the ear canal earpiece by way of the ear canal to the eardrum of the user.

The frequency response of such an arrangement can be composed of the frequency response of the earpiece and the frequency response of the ear. The ear canal which is closed with the ear canal earpiece has a resonance behaviour upon excitation with a given resonance frequency. The precise position of that resonance frequency is dependent on the geometry of the ear canal, the position at which the ear canal earphone is in ear canal and also acoustic properties of the ear canal earpiece. The resonance frequency being considered can be for example approximately at 7.5 kHz. The excessive increase in the sound level, caused by the resonance behaviour, in the region of about 7.5 kHz, can have a detrimental effect on the quality of sound.

DE 10 2006 042 209 B2 discloses an earplug-like earpiece with a regulatable volume of a front chamber arranged between the loudspeaker and the housing.

DE 37 06 481 A1 discloses an earpiece.

US No 2008/0095393 A1 discloses an in-ear earpiece.

US No 2001/0050997 A1 describes an in-ear earpiece having a holding ring.

U.S. Pat. No. 4,298,087 discloses a bidirectional loudspeaker.

DE 10 2005 012 711 A1 discloses headphones.

DE 35 40 579 A1 discloses a hearing aid.

JP 08037697 A discloses a hearing aid.

SUMMARY OF THE INVENTION

Accordingly the object of the present invention is to improve the sound quality of an earpiece. In particular the aim of the invention is to compensate for influences of the ear canal on the sound quality. A further or alternative object is to reduce an excessive increase in ear canal resonance.

That object is attained by an earphone and by an ear pad for an earpiece as set forth in the claims.

Thus there is provided an (ear canal) earpiece having a first side (towards the ear), an acoustic transducer for outputting a sound signal and a sound guide element having a first end and a second end. In that case the first end of the sound guide element faces the acoustic transducer and the second end faces the first end of the (ear canal) earpiece. The sound guide element serves for guiding the sound signal to an ear canal of a user. In that case the sound guide element has a sound guide unit having a first opening at its second end. The (ear canal) earpiece also has at least one volume element which delimits a volume and which has at least one second opening for connecting the volume to the first side of the (ear canal) earpiece.

When such an earpiece such as for example an ear canal earpiece is used by a user the second opening of the volume element connects exclusively the ear canal and the volume element. That also means that the second opening of the volume element does not directly connect the volume defined by the volume element and an internal region of the sound guide element. The first opening of the sound guide element and the second opening of the ear canal are for example arranged separately from each other.

The sound guide element guides the sound from the acoustic transducer to the interface between the (ear canal) earpiece and the ear canal of a user. The sound guide element is for example in the form of a tube connecting the acoustic transducer to the ear canal of a user. The volume element is embodied for example by a housing in which for example there is a cavity. The second opening connecting the volume to the ear canal of a user is embodied for example by a hole or also by a tube or a tube arrangement. The tube or the tube element or the second opening opens into the ear canal of a user when the ear canal earpiece is inserted into the ear canal of the user.

The (ear canal) earpiece according to the invention provides that the ear canal of a user, when the (ear canal) earpiece is fitted into the ear canal, is air-tightly closed by the ear canal earpiece. The volume of the ear canal is connected to the volume of the volume element by way of the second opening. A Helmholtz resonator is formed by the acoustic mass of the opening and the volume of the volume element.

That Helmholtz resonator can be tuned in such a way that the increase in resonance caused by the resonance frequency of the ear canal is reduced. Frequencies in that region are quasi absorbed by the resonator arrangement, for which reason the arrangement is also referred to as an acoustic absorption circuit. The increase in resonance which is for example at about 7.5 kHz is reduced in that way.

The geometrical dimensions of the second opening or the tube or the tube element determine the acoustic properties, for example the Helmholtz resonance frequency of the acoustic absorption circuit.

In an aspect of the present invention the first opening of the sound guide element and the at least one second opening of the volume element are arranged in mutually juxtaposed relationship. Thus the second opening is not in the first opening and that therefore avoids the acoustic properties of the sound guide element being adversely affected.

In an aspect of the present invention the volume element is arranged around the sound guide element. That provides for a space-saving arrangement of the volume element and the sound guide element, which allows miniaturisation of the (ear canal) earpiece. In addition the volume of the volume element can be enlarged with only a slight increase in the dimensions of the (ear canal) earpiece.

In an aspect of the present invention the volume of the volume element is adjustable. Adjustment of the volume or the size of the volume makes it possible to adjust acoustic properties, for example the resonance frequency of the Helmholtz resonator and/or the quality of the resonance circuit. The desired frequency also depends on the geometry of the respective ear canal of the user. As different users have ear canals of different geometries, it is thus possible to achieve effective adaptation of the absorption frequency by a change in the volume. The volume can be achieved for example with a small slider which moves a wall within the volume element and thus changes the volume. Alternatively a change in the volume can be achieved by deformation of the volume element.

In an aspect of the present invention a damping element is mounted at the at least one second opening. In that way it is possible to alter an acoustic resonance of the second opening and thus the acoustic properties of the resonance arrangement can be altered. For example a fabric can be used as the damping element.

In a further aspect of the present invention the (ear canal) earpiece has a first housing portion which forms the volume element and the sound guide element and which has a receiving unit for the acoustic transducer.

In an aspect of the present invention the first opening of the sound guide element and the at least one second opening of the volume are disposed on a side of the first housing portion, that is towards the ear canal of the user. That avoids in particular the second opening being closed for example by the wall of the ear canal.

In an aspect of the present invention the (ear canal) earpiece has a second housing portion having a connecting device for the acoustic transducer, wherein the first housing portion can be pushed on to and pulled off the second housing portion. That provides for easy interchangeability of a possibly defective acoustic transducer. Likewise different first housing portions can be fitted on to the second housing portion. They differ for example in their external dimensions which are selected in accordance with the geometry of the ear canal of the respective user, or in the geometry of the second opening and/or the volume, whereby the acoustic properties, for example the resonance frequency of the overall acoustic arrangement or the quality of the arrangement consisting of the (ear canal) earpiece and the ear canal can be altered. A first housing portion can thus be adapted on the one hand by virtue of its size or geometrical dimensions to the special geometry of an ear canal of a user and also by the configuration of the volume and the second opening, to a special ear canal resonance increase of a given user.

The invention also concerns an ear pad for an (ear canal) earpiece. The ear pad has a first end for insertion into an ear canal of a user and a second end for fixing the ear pad to a first end of an ear canal earpiece. The ear pad also has a sound guide element unit having a first opening at the first end of the ear pad for guiding a sound signal from an ear canal earpiece from a second end of the ear canal earpiece to the first end of the ear canal earpiece and at least one volume element which delimits a volume and which has at least one second opening at the first end of the ear canal earpiece for connecting the volume to the ear canal.

Such an ear pad is suitable, in conjunction with the ear canal and the ear canal earpiece, thereby to form a resonance arrangement comprising an ear canal, the volume of the volume element and the second opening, wherein the resonance arrangement reduces a self-resonance increase of the ear canal, which is for example at 7.5 kHz. When such an ear pad together with an ear canal earpiece is inserted into the ear canal of a user, the volume of the volume element, the second opening and the ear canal co-operate like a Helmholtz resonator. The unwanted resonance properties of the ear canal can thus be altered by adaptation of the volume or the second opening. In particular the volume and the second opening can be so dimensioned that an excessive increase in resonance, which is at about 7.5 kHz, is avoided.

The features already disclosed in respect of the ear canal earpiece according to the invention can also be appropriately transferred to the ear pad according to the invention. In that respect in particular the mutually juxtaposed arrangement of the first opening and the second opening, the arrangement of the volume element around the sound guide element, the adjustability of the volume of the volume element and the use of a damping element is meant.

In an aspect of the present invention the fixing device is in the form of a flange. If the ear pad is made for example from a deformable material, for example rubber, then the ear pad can be pushed for example on to a groove-like structure of a housing of an ear canal earpiece and can be pulled off again.

In a further aspect the volume element of the ear pad is of such a configuration that the volume of the volume element does not alter upon insertion of the ear canal earpiece into the ear canal of a user. That can be achieved for example by the use of stabilisation ribs or by the use of a plastic housing which encloses the volume. In that way for example the acoustic properties are prevented from being altered by an unwanted change in the volume.

In a further aspect of the invention an ear canal earpiece has an ear pad according to the invention, wherein the ear pad can be pushed on to and pulled off the ear canal earpiece. In that way a damaged ear pad can be easily replaced and an ear canal earpiece can be equipped, in dependence on the respective user, with a suitable ear pad which on the one hand is adapted to the geometrical dimensions of the ear canal of the respective user and in which on the other hand its volume and second opening are so adjusted that an excessive increase in resonance, caused in the ear canal, is well avoided.

Developments of the invention are recited in the appendant claims.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
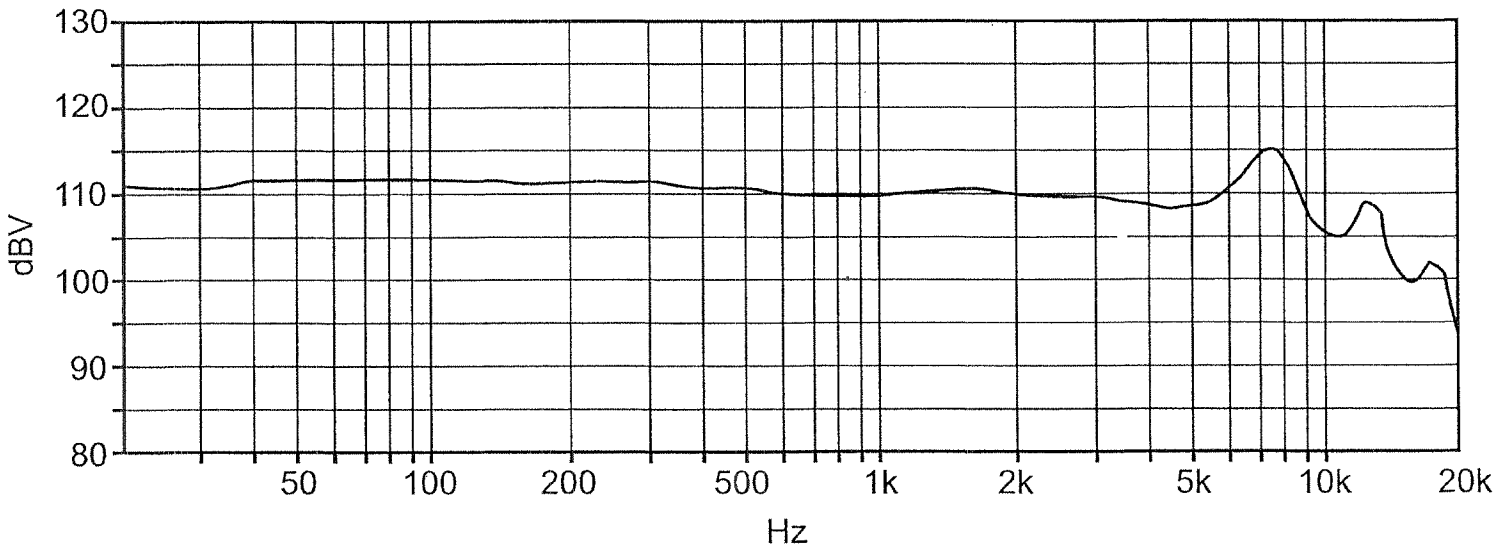
FIG. 1 shows a typical frequency response of an arrangement having an ear canal earpiece and an ear canal in accordance with the state of the art.

FIG. 1 shows a typical frequency response of an arrangement having an ear canal and an ear canal earpiece in accordance with the state of the art. The frequency is logarithmically shown at 20 Hz through 20 Hz on the X-axis. The Y-axis represents the amplitude of the frequency response from 80 through 130 dBV. The ear canal of a user is closed by the ear canal earpiece and that arrangement has a resonance frequency. That is to say, certain tones, that is to say sound at given frequencies, which the earpiece outputs, are in the resonance range of the arrangement and can accordingly be perceived by a user in amplified form. That resonance is a property of the ear canal which is closed by the ear canal earpiece. The precise position of the resonance frequency is dependent on the geometry of the ear canal, the position at which the ear canal earpiece is disposed in the ear canal, and the acoustic properties of the ear canal earpiece. That resonance is frequency at about 7.5 kHz. The resonance increase shown in FIG. 1 in the region between 6 and 9 kHz, wherein the maximum is at about 7.5 kHz, is to be attributed to the resonance of the closed ear canal.

Figure 2:
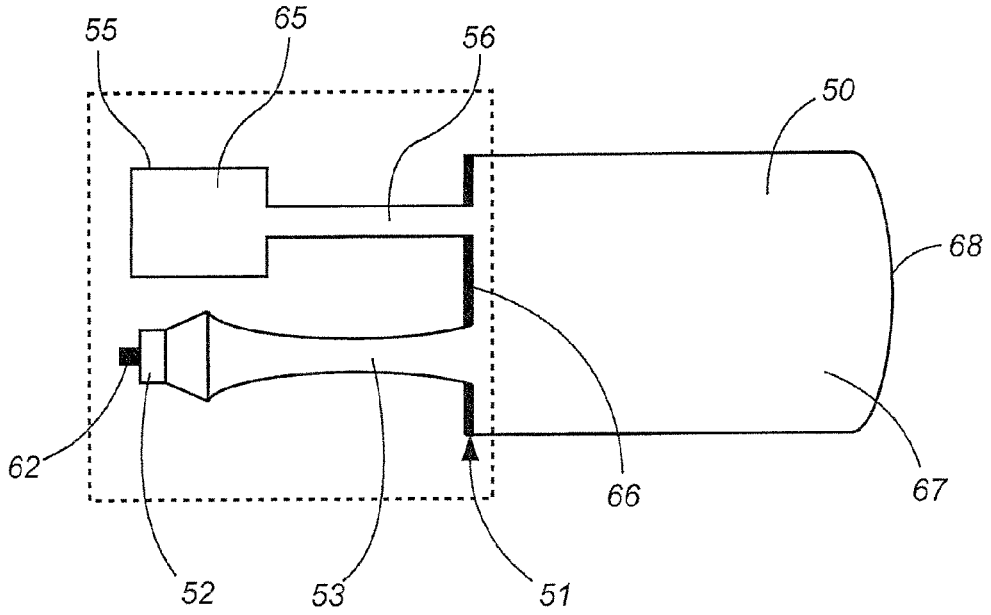
FIG. 2 is a view showing the principle of an ear canal earpiece in accordance with a first embodiment.

FIG. 2 shows a view illustrating the principle of an ear canal earpiece 51 according to a first embodiment. An ear canal 50 is air-tightly closed with an ear canal earpiece 51. The ear canal earpiece 51 has a volume element 55, a tube portion 56, a sound transducer 52 and a sound guide element 53. The volume element 55 delimits a volume 65. The volume 65 is connected by way of the tube portion 56 through an air-tight terminal closure 66 of the ear canal 50 to a second volume 57 of the ear canal 50. The ear canal 50 is closed off on the side opposite the closure 66, with an ear drum 68. The acoustic sound transducer is connected by way of the sound guide element 53 through the air-tight closure 66 to the second volume 67 of the ear canal 50. The ear canal earpiece 51 also has an electrical connection 52 by way of which the acoustic sound transducer 52 is fed with an electrical signal which the acoustic sound transducer 52 converts into a corresponding sound.

Sound waves pass from the acoustic transducer 52 by way of the sound guide element 53 which for example is in the form of a tube portion, into the second volume 67 of the ear canal 50. On the assumption that the tube portion 56 connecting the second volume 67 to the volume 65 is closed in the closure 66 of the ear canal, the arrangement comprising the sound guide element 53 and the ear canal 50 presents a certain resonance behaviour. In other words, acoustic waves of a given frequency or a given frequency range experience resonance in the arrangement. The user can perceive sound waves in the resonance frequency range more strongly than sound waves in other frequency ranges. The range of the resonance increase caused by the resonance is for example between 6 and 9 kHz (see FIG. 1). The exact range however depends in particular on the geometrical dimensions of the ear canal and the sound guide element 53 which are individually different.

If now the tube portion 56 which connects the second volume 67 to the volume 65 is not closed, then the volume 65 co-operates with the tube portion 56 like an acoustic absorption circuit which absorbs certain frequencies and thus at least reduces the resonance increase of the arrangement consisting of the sound guide element 53 and the second volume 67. In that respect the mass of air within the tube portion 56 vibrates against the elasticity of the mass of air which is in the volume 65. The volume element 55 and the tube portion 56 together form a resonator which is also referred to as a Helmholtz resonator.

The specific configuration of the volume element which for example establishes the size of the volume and the specific configuration of the tube portion 56, for example length, cross-section, inserted damping material, mean that the desired parameters of the resonator are adjustable. Such a parameter is for example the frequency which the resonator comprising the arrangement consisting of the sound guide element and the second volume 67 is intended to absorb. The resonator is therefore tuned in such a way that its resonance corresponds to the interfering resonance which is in the range of between about 6 and 9 kHz. Accordingly the resonator acts as an acoustic absorption circuit which reduces the sound pressure in the ear duct in the region of the interfering resonance frequency.

Figure 3:
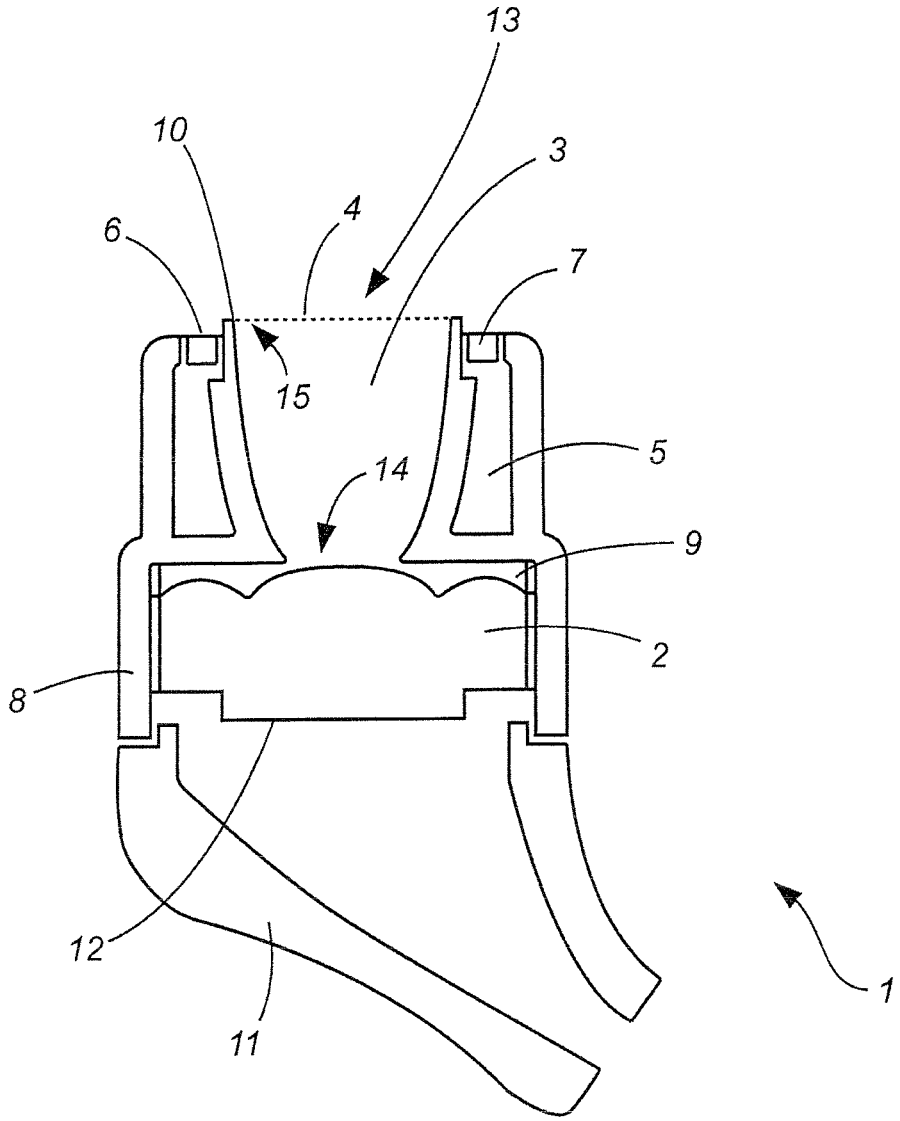
FIG. 3 shows a sectional view of an ear canal earpiece in accordance with a second embodiment.

FIG. 3 shows a sectional view of an ear canal earpiece 1 in accordance with a second embodiment. the ear canal earpiece 1 has a first side 13 (towards the ear) which serves for insertion into an ear canal of a user. The ear canal earpiece 1 further includes a first housing portion 8 which has a volume element 5 and a sound guide element 3. The sound guide element 3 has a first end 14, a second end 15 and a through opening 4. The through opening can be in the form of a sound guide unit or a sound guide canal. The first end 14 faces an acoustic transducer 2 and the second end 15 faces the first side 13 of the ear canal earpiece 1. The sound guide element 3 with the sound guide unit which blends into the opening 4 serves to guide a sound signal to an ear canal of a user. The first housing portion 8 also has a receiving unit 9 for the acoustic transducer 2, a second opening 6 of the volume element 5 and the first opening 4 of the sound guide element 3. A damping element 7 which is formed from a fabric can be provided in the second opening 6. The resonance frequency of the resonator consisting of the second opening 6 and the volume element 5 is established by the choice of the damping element and the dimensions of the second opening. The size of a volume 14 of the volume 5 serves to adjust parameters of the resonator. Such a parameter is for example also the quality of the resonator.

The volume element 5 can be arranged in ring form around the sound guide element 3. That provides a space-saving arrangement in respect of the sound guide element 3 and the volume element 5. The first opening 4 of the sound guide unit or canal is on a side 10 of the first housing portion. The second opening 6 of the volume element 5 is also on the side 10. The first opening 4 and the second opening 6 are arranged in mutually juxtaposed relationship on the side 10 of the first housing portion. That provides an air-fight closure of the ear canal, a connection between the first opening and the ear canal and a second opening which is separate from the first opening and which is connected to the ear canal. The second opening 6 can open into the ear canal, it should however not open into the sound guide element 3. If the second opening 6 were to open into the sound guide element 3 then sound guidance would lose its effect and the acoustic absorption circuit would detrimentally influence the frequency response of the earpiece.

The first housing portion 8 can be pushed on to a second housing portion 11. An electrical signal is fed to a connecting device 12 by way of the second housing portion 11. That electrical signal is converted by the acoustic transducer 2 into a sound signal which is propagated along the sound guide means. The volume 14 of the volume element 5 can be adjustable. For example, a slider is arranged in the volume element 5, and can alter the size of the volume 14. In that way the acoustic properties of the resonator consisting of the volume element 5 and the second opening 6 are adjustable. The first housing portion 8 can be pulled off the second housing portion 11 and can be pushed on to the second housing portion 11. In that way for example the acoustic transducer 2 can be replaced in the case of a defect. Equally it is possible for different first housing portions to be fitted on to the second housing portion 11. The different housing portions differ for example in external dimension which is to be adapted to a given ear canal, and in the dimensions of the volume 14 and the opening 6, which are to be matched to a user-specific ear canal resonance. In that way a first housing portion can be selected or adapted in relation to a specific user or the specific ear canal thereof.

Figure 4:
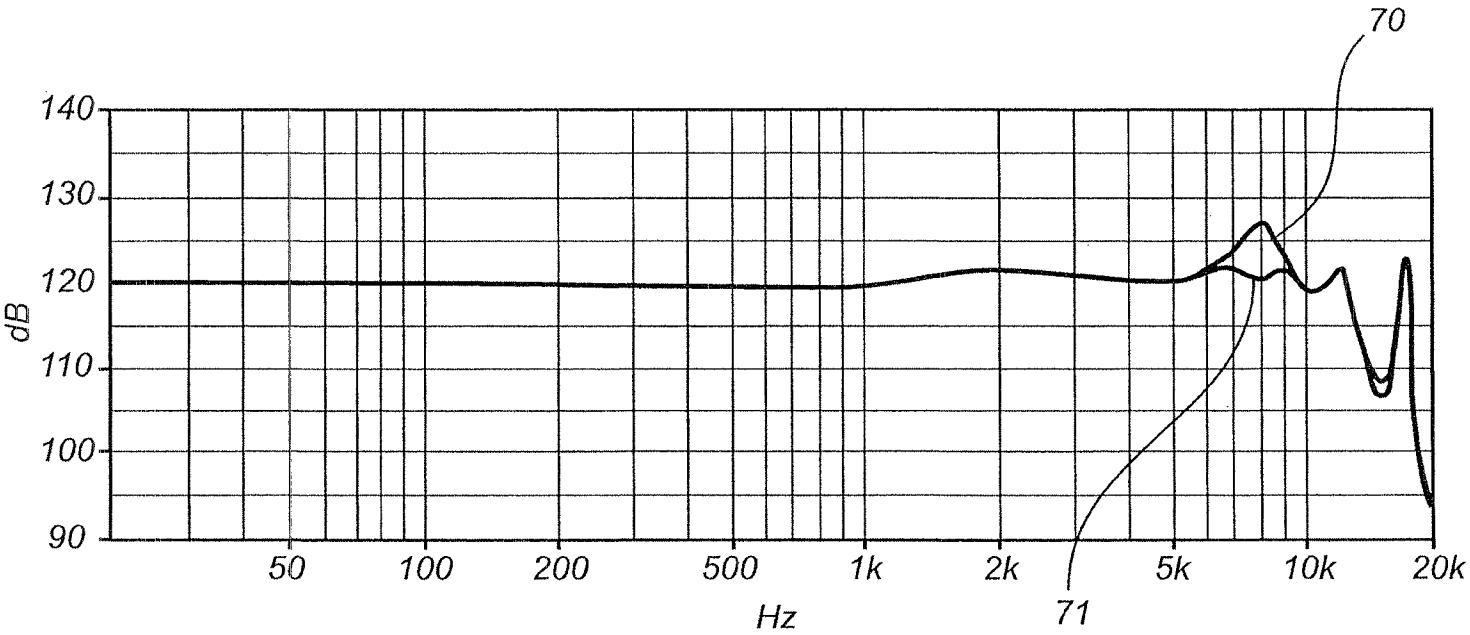
FIG. 4 shows a typical frequency response of an arrangement having an ear canal and an ear canal earpiece according to the invention.

FIG. 4 shows a first typical frequency response 71 of an arrangement having an ear canal earpiece according to the invention in comparison with a second typical frequency response 70 of an arrangement having an ear canal earpiece in accordance with the state of the art. A frequency of between 20 Hz and 20 kHz is logarithmically represented on the X-axis while an amplitude of between 90 and 140 dB is represented on the Y-axis. The frequency increase of the first typical frequency response 70 in the range between 6 and 9 kHz which is also caused by the resonance of the user-specific ear canal has been reduced with the ear canal earpiece according to the invention, as shown in the second frequency response 71.

Figure 5:
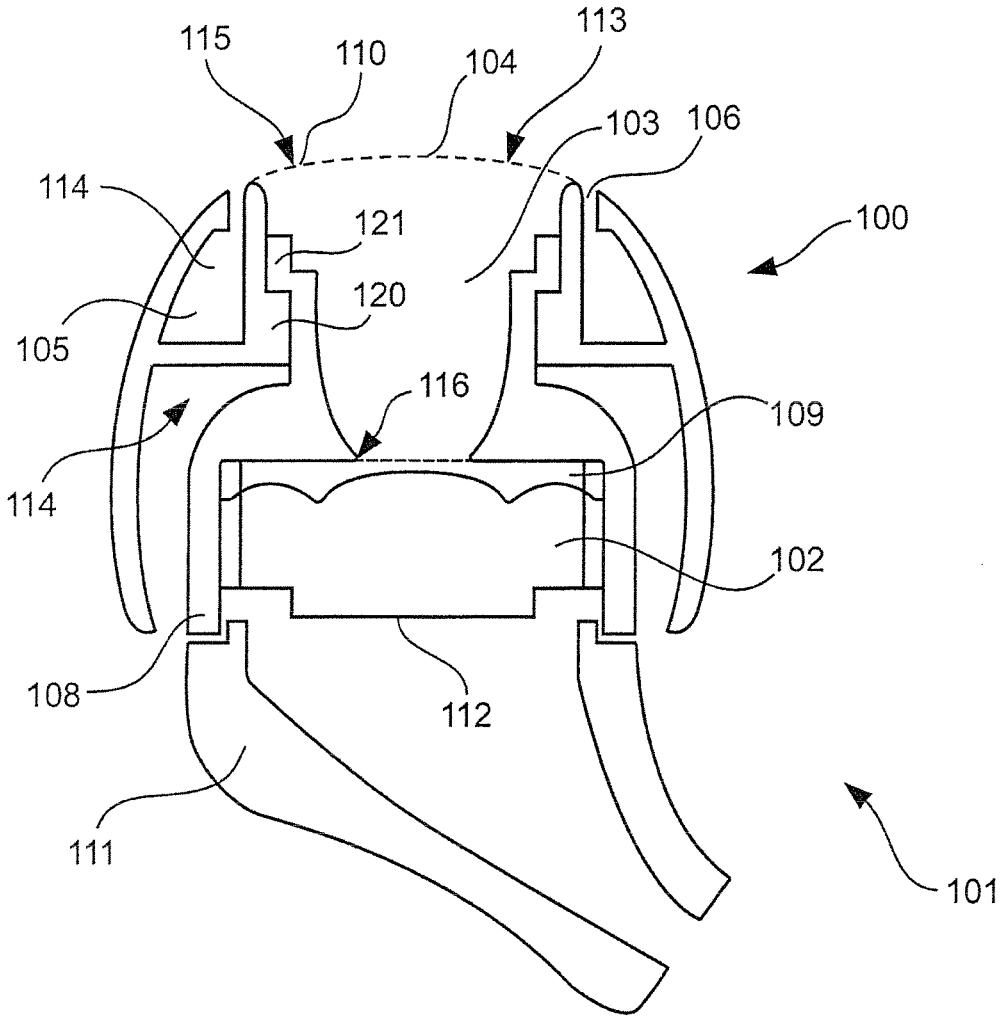
FIG. 5 shows a sectional view of an ear pad and an ear canal earpiece in accordance with a third embodiment.

FIG. 5 shows a sectional view of an ear pad 100 and an ear canal earpiece 101 in accordance with a third embodiment. The ear pad 100 has a first end 113 for insertion into an ear canal of a user and a second end 114. The ear canal earpiece 101 has a first end 115 and a second end 116. The second end 114 serves for fixing the ear pad 100 at the first end 115 of the ear canal earpiece 101. A volume element 105 and a second opening 106 of the volume element 105 are integrated into the ear pad 100. The second opening 106 is at the first end 115 of the ear canal earpiece 101. The ear pad also has a first opening 104 through which the sound can pass through a sound guide unit 103 to an ear canal. The first opening 104 is at the first end 113 of the ear pad 100. The sound guide unit 103 serves for guiding a sound signal from an ear canal earpiece from the second end 116 of the ear canal earpiece 101 to the first end 115 of the ear canal earpiece 101.

The volume 114 of the volume element 105 is not intended to be altered upon insertion of the ear canal earpiece 101 into an ear canal. That can be effected for example by the provision of ribs or by a plastic casing which surrounds or forms the volume.

The ear pad 100 has a fixing device which for example is in the form of a first flange 120. The ear pad can be fixed to a first housing portion 108 of the ear canal earpiece 101 with the first flange 120. The first housing portion 108 forms the sound guide unit 103 and has a second flange 121 serving to hold the first flange 120 of the ear pad 100. For example the ear pad 100 is made from a rubber-like material so that the ear pad can be fitted over the first housing portion 108 and the rubber-like flange 120 bears against the second flange 121. That makes it possible for the ear pad to be fitted on to and pulled off the first housing portion 108.

The first opening 104 of the sound guide unit 103 and the second opening 106 of the volume unit 105 of the ear pad 100 are on a side 110 of the ear canal earpiece, which faces in the direction of the ear canal of a user. The first opening 104 and the second opening 106 are arranged separately from each other so that the effect of the resonator consisting of the volume element 105 and the second opening 106 can be deployed. The volume 114 of the volume unit 105 can be adjustable. Different ear pads can differ in respect of their external dimensions, their second opening and their volume unit. In that way the ear pad can be adapted to the dimensions of an individual ear canal of a user and at the same time a desired resonance effect which is adapted to the geometry of the individual ear canal can be embodied by a suitable choice of the volume 114 and the second opening 106.

The first housing portion 108 has a receiving unit 109 for an acoustic transducer 102. The first housing portion 108 can be connected to a second housing portion 111 in such a way that it can be pushed thereonto and pulled therefrom. In that way the acoustic transducer 102 can be easily replaced for example in the case of a defect. By way of the second housing portion 111 an electrical signal is fed to the acoustic transducer 102 by way of a connecting device 112, the acoustic transducer 102 converting the electrical signal into a sound signal which can pass along the sound guide unit 103 through the first opening 104 to an ear canal. The effect shown in FIG. 4 can be achieved with the illustrated arrangement of the ear canal earpiece 101 or with the ear pad 100. In particular an excessive increase in resonance, in particular in the range of between 6 and 9 kHz, which is also caused by the individual ear canal, is implemented by the resonance unit which is disposed in the ear pad 100 and which consists of the volume unit 105 and the second opening 106. A damping element can also be introduced into the second opening 106 to alter the acoustic properties of the resonator, for example its quality or its resonance frequency. At the same time such a damping material makes it possible to achieve contamination of the second opening 106 or the volume element 105. The volume 114 of the ear pad 100 can also be made adjustable.

Figure 6:
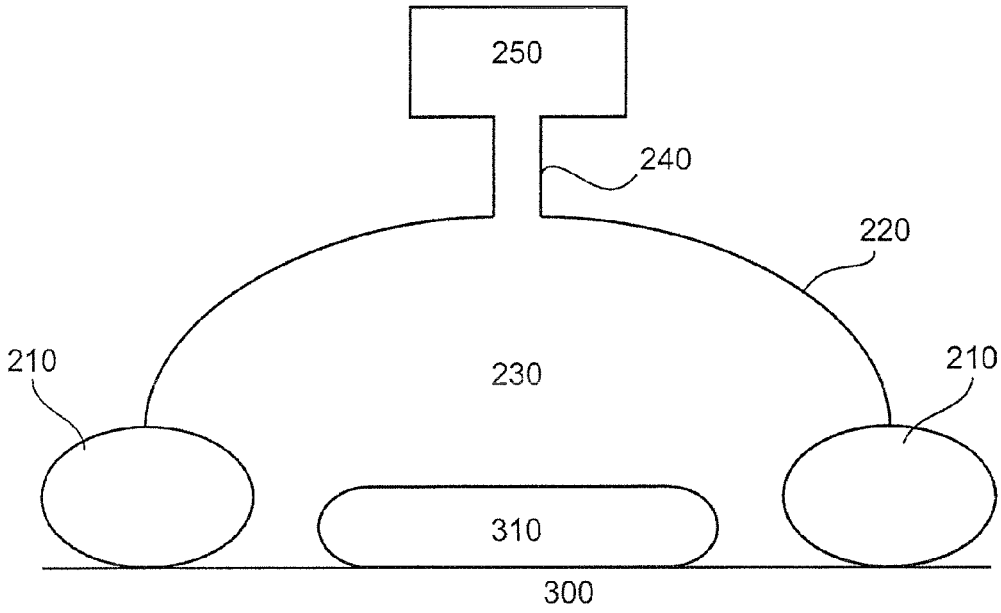
FIG. 6 shows a diagrammatic view of an earpiece in accordance with a fourth embodiment.

FIG. 6 shows a diagrammatic view of an earpiece in accordance with a fourth embodiment. While embodiments 1 through 3 relate to ear canal earpieces the fourth embodiment concerns a circumaural earpiece. The circumaural earpiece has an ear pad 210, a sound wall 220 and a volume 230 which is enclosed by the ear pad 210, the sound wall 220 and the head 300 or the ear 310 of the earpiece and which is connected by way of a tube 240 to a further volume 250. In this case the tube 240 acts as an acoustic mass.

Figure 7:
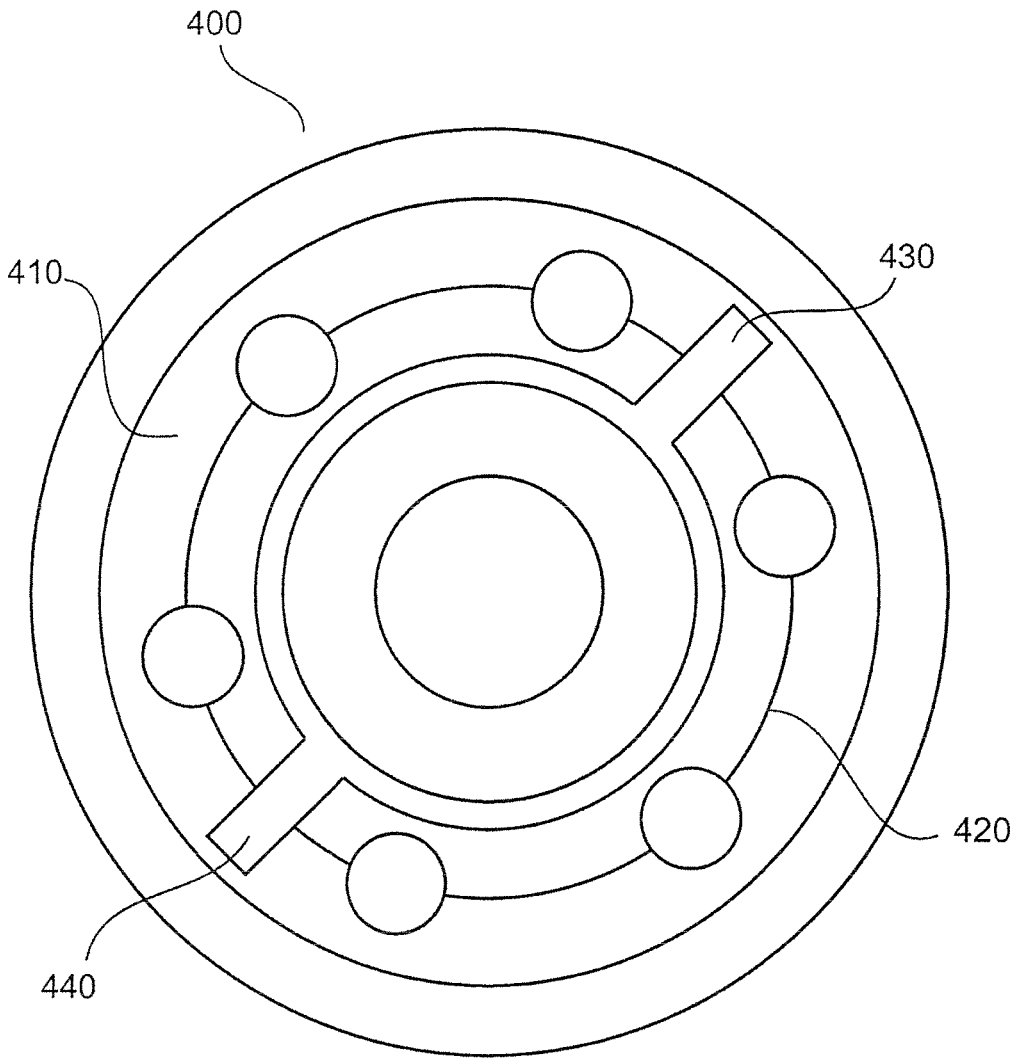
FIG. 7 shows a plan view of an earpiece in accordance with a fourth embodiment.

FIG. 7 shows a diagrammatic plan view of an earpiece according to a fourth embodiment. In this case the earpiece of the fourth embodiment is substantially based on the earpieces in accordance with the first through third embodiments and in particular the Figure shows a volume body 400 arranged in a ring form. That volume body has a first volume 410 and a second volume 420 which are divided into two independent volumes by first and second separating walls 430, 440.

Thus the first and second volumes together with the openings leading thereto have an independent Helmholtz resonator. In this arrangement those two resonators can be tuned independently of each other. That is advantageous as it is possible to achieve a lowering of two frequencies. The size of the first and second volumes and the number and size of the openings connected thereto can be selected independently of each other.

Alternatively thereto it is also possible to provide more than two volumes.

The volume body arranged in a ring form, in accordance with the fourth embodiment, can be used in an ear canal earpiece in accordance with the first, second or third embodiment.

Figure 8:
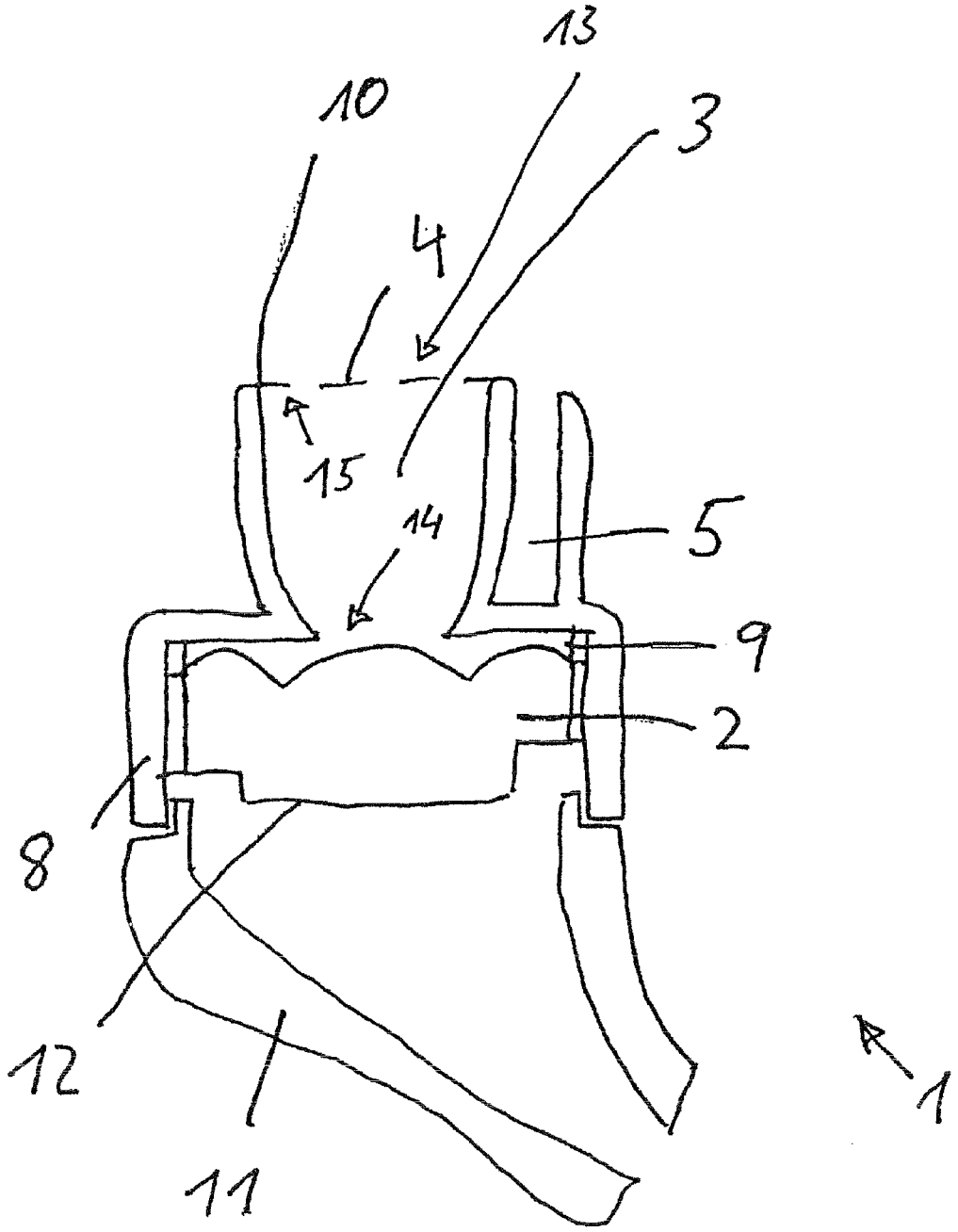
FIG. 8 shows a sectional view of an ear canal earpiece in accordance with a fifth embodiment.

FIG. 8 shows a sectional view of an ear canal earpiece in accordance with a fifth embodiment. In this case the ear canal earpiece of the fifth embodiment substantially corresponds to the ear canal earpiece of the second embodiment shown in FIG. 3. While however in the second embodiment the volume 5 or the volume unit 5 is of a ring-shaped configuration, the volume element 5 in the fifth embodiment can be in the shape of a segment of a circle. As an alternative thereto the volume element 5 of the fifth embodiment can be of a rectangular or circular cross-section. The volume element 5 of the fifth embodiment is provided for example only on one side or in the form of a portion.

A damping element can optionally be provided at the opening of the volume element 5. As also in the second embodiment, the opening of the volume element 5 is provided at the end, that is towards the ear, of the ear pad or the earpiece.

Figure 9:
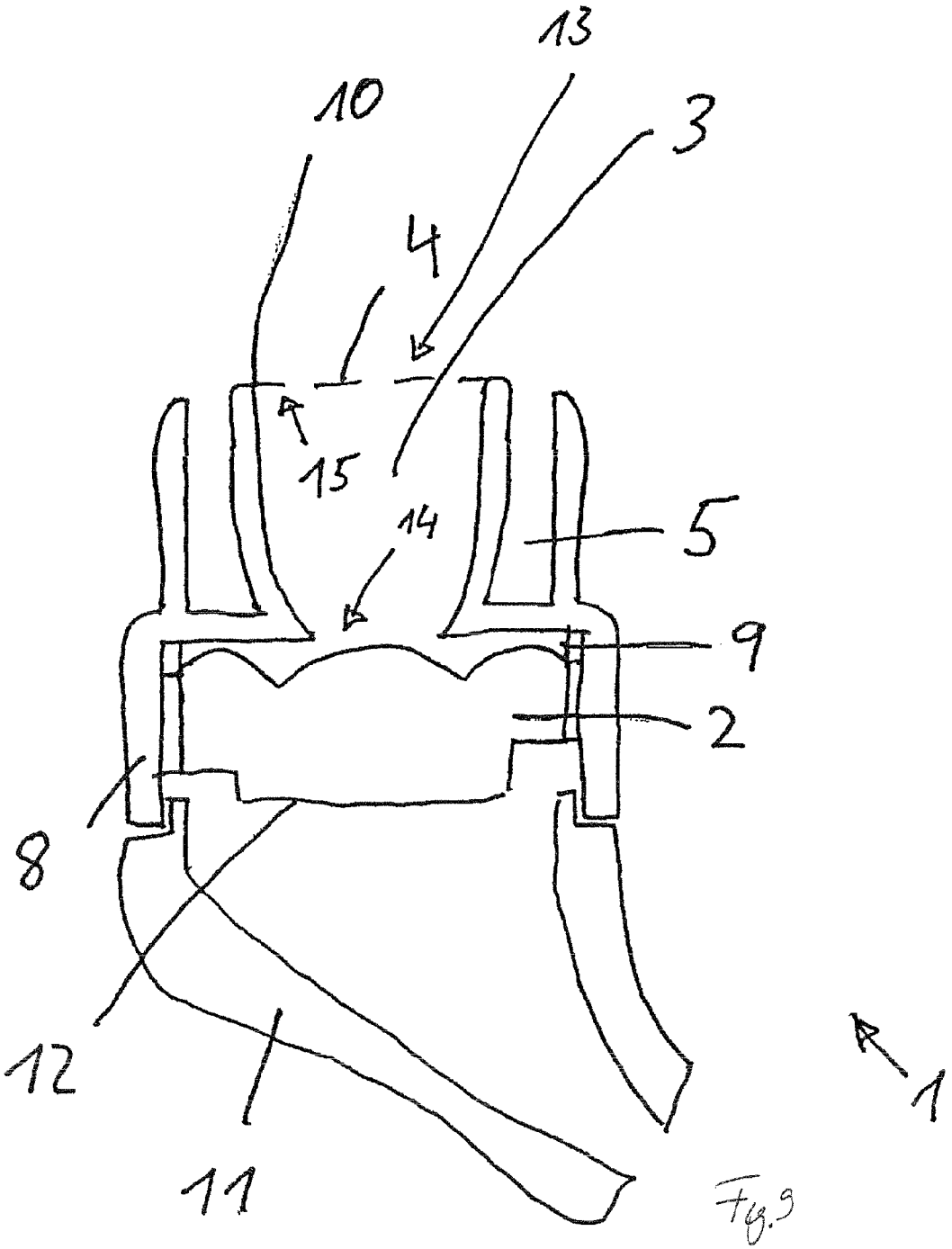
FIG. 9 shows a sectional view of an ear canal earpiece in accordance with a sixth embodiment.

FIG. 9 shows a sectional view of an earpiece in accordance with the sixth embodiment. The earphone or ear canal earpiece according to the sixth embodiment can be based in this respect on the ear canal earpiece of the second embodiment shown in FIG. 3. In contrast to the ear canal earpiece of the second embodiment in FIG. 3 the ear canal earpiece according to the sixth embodiment does not have a damping element at the opening of the volume element. In this case the volume element 5 can be designed as in the second embodiment. In other words the volume element can be of a ring-shaped configuration or an at least partially ring-shaped configuration.

Figure 10:
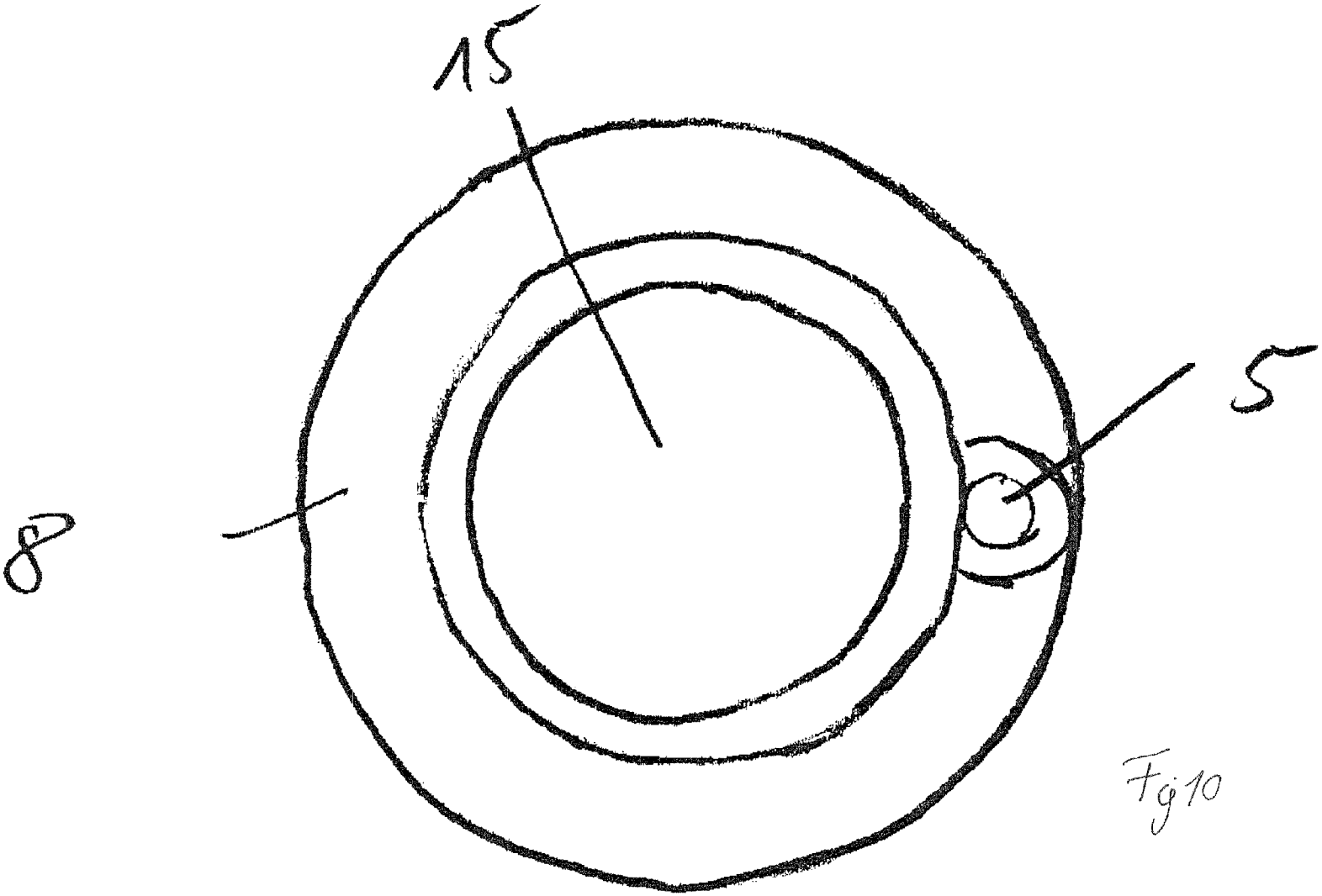
FIG. 10 shows a plan view of an earpiece in accordance with a seventh embodiment.

FIG. 10 shows a plan view of an earpiece in accordance with the seventh embodiment. The earpiece of the seventh embodiment can be based on an earphone in accordance with embodiments 1 through 6. FIG. 10 shows in particular the second end 15 of the sound guide element and the first housing portion 8. In addition the volume element 5 is shown optionally with a damping element. In that respect it is to be seen that the volume element 5 is provided only on one side of the earpiece and is of an at least partially circular cross-section. The opening of the volume element 5 is in this case provided beside the opening 15 of the sound guide element (on the side that faces the ear).

Figure 11:
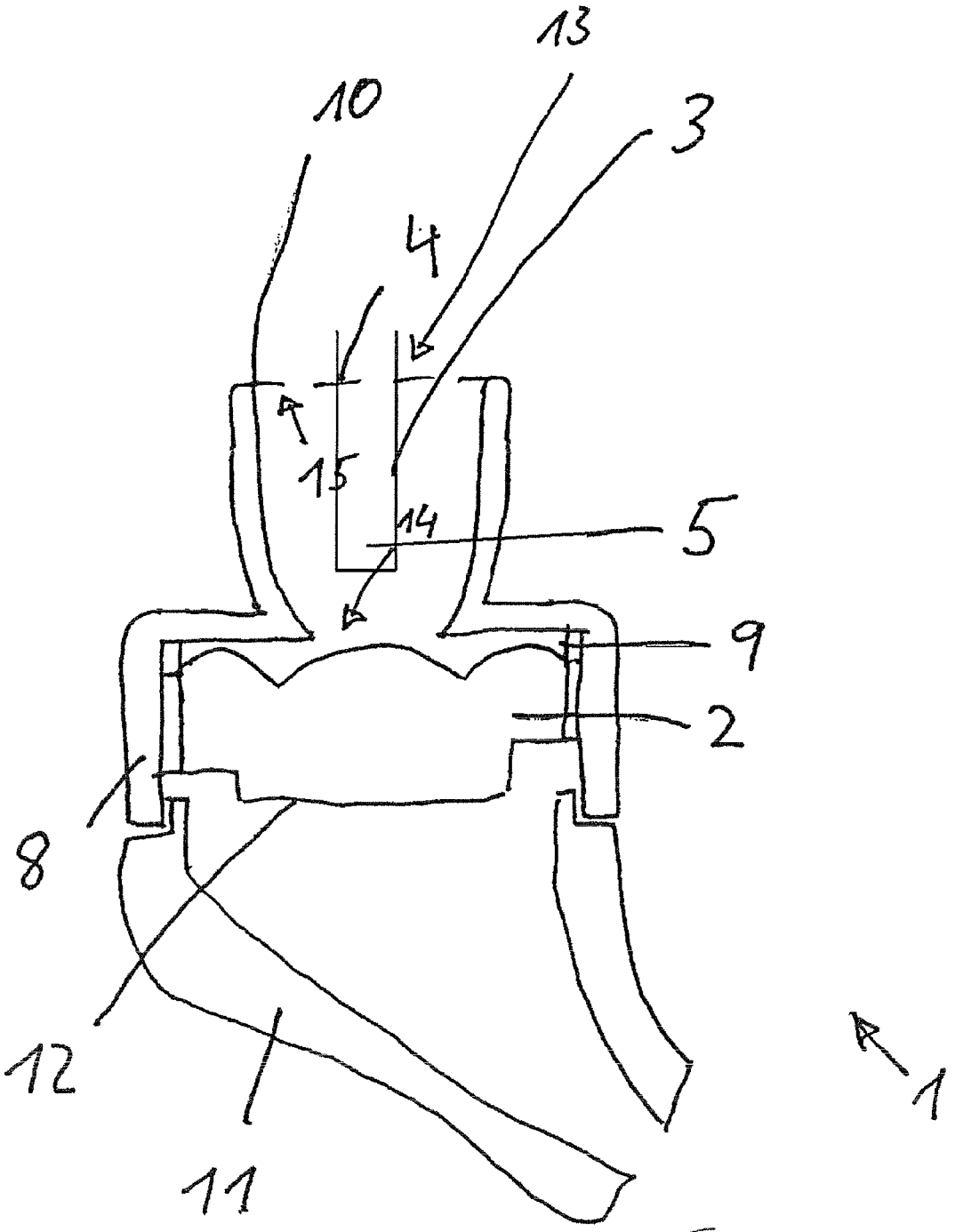
FIG. 11 shows a sectional view of an ear canal earpiece in accordance with an eighth embodiment.

FIG. 11 shows a sectional view of an ear canal earpiece according to an eighth embodiment. In this case the ear canal earpiece of the eighth embodiment can be based on an ear canal earpiece in accordance with one of embodiments 1 through 7. In the eighth embodiment the volume unit 5 with its opening is not outside the sound guide unit (as in embodiments 1 through 7) but is within the sound guide unit. The volume unit 5 has a single opening which faces the first side of the earpiece 13. The ear canal earpiece of the eighth embodiment is advantageous because in that way it is possible to provide a compact small sound guide element as the volume element is disposed within the sound guide unit.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An earpiece comprising:

a first side towards an ear of a user;

an acoustic transducer for outputting a sound signal; and a sound guide element including:

a first end facing the acoustic transducer;

a second end facing the first side of the earpiece;

a sound guide unit having a first opening at the second end of the sound guide for guiding the sound signal to an ear canal of the user; and at least one volume element which delimits a volume and which has a second opening for connecting the volume to the first side of the ear canal earpiece;

wherein the first opening and the second opening are arranged in mutually juxtaposed or mutually adjacent relationship; and wherein a Helmholtz resonator is formed by the volume element having the second opening.

2. The earpiece as set forth in claim 1;

wherein the second opening is in the form of at least one tube element.

3. The earpiece as set forth in claim 1;

wherein the volume element is arranged at least partially around the sound guide element or in the sound guide element.

4. The earpiece as set forth in claim 1;

wherein the volume of the volume element is adjustable.

5. The earpiece as set forth in claim 1;

wherein a damping element is mounted at the second opening.

6. The earpiece as set forth in claim 1, further comprising a first volume portion which forms the volume element and the sound guide element and which has a receiving unit for the acoustic transducer.

7. The earpiece as set forth in claim 1, further comprising:

a second housing portion which has a connecting device for the acoustic transducer;

wherein the first housing portion can be fitted on to and removed from the second housing portion.

8. The earpiece as set forth in claim 1;

wherein the earpiece is in the form of an ear canal earpiece and the first side is adapted for insertion into an ear canal of a user.

9. The earpiece as set forth in claim 1;

wherein the earpiece is adapted to form a resonator when it is placed into an ear of a user.

10. The earpiece as set forth in claim 1;

wherein the earpiece is adapted to form a Helmholtz resonator when it is placed into an ear of a user.

11. An ear pad for an earpiece comprising:

a first end for insertion into an ear canal of a user; and a second end for fixing the ear pad at a first end of an earpiece;

a sound guide unit having a first opening at the first end of the ear pad for guiding a sound signal from an ear canal earpiece from a second end of the earpiece to the first end of the earpiece; and at least one volume element which delimits a volume and which has a second opening at the first end of the earpiece, which connects the volume to the ear canal;

wherein the first opening and the second opening are arranged in mutually juxtaposed or mutually adjacent relationship; and wherein a Helmholtz resonator is formed by the volume element having the second opening.

12. The ear pad as set forth in claim 11;

wherein the fixing device is in the form of a flange.

13. The ear pad as set forth in claim 11;

wherein the volume element is of such a configuration that the volume of the volume element does not change upon insertion of the earpiece into the ear canal of a user.

14. An ear canal earpiece comprising:

an ear pad as set forth in claim 10;

wherein the ear pad can be pushed on to the earpiece and can be pulled off the earpiece.

15. The ear canal earpiece as set forth in claim 14, further comprising:

a housing portion which has a second flange for fixing the ear pad.

* * * * *